United States Patent [19]

Weaver

[11] Patent Number: 4,949,525

[45] Date of Patent: Aug. 21, 1990

[54] ROTATABLE, FLEXIBLE FLAGPOLE ARRANGEMENT

[76] Inventor: John H. Weaver, 207 Hawkins Dr., Brainerd, Minn. 56401

[21] Appl. No.: 326,280

[22] Filed: Mar. 21, 1989

[51] Int. Cl.[5] ..... E04C 3/30

[52] U.S. Cl. ..... 52/720; 52/726; 403/292; 403/306; 403/379; 116/173

[58] Field of Search ..... 52/720, 726, 721, 114, 52/301; 116/174, 173; 248/511; 40/218; 73/188; 403/292, 306, 379

[56] References Cited

U.S. PATENT DOCUMENTS

| | | | |
|---|---|---|---|
| 510,625 | 12/1893 | Wright | 52/154 |
| 689,077 | 12/1901 | Griffith | 116/174 |
| 859,233 | 7/1907 | Lane | 52/111 |
| 892,069 | 6/1908 | Moore et al. | 52/301 |
| 997,435 | 7/1911 | Bowman | 52/727 |
| 1,420,669 | 6/1922 | Schutte | 29/155 C |
| 1,420,670 | 6/1922 | Schuette | 403/292 |
| 1,631,566 | 6/1927 | Watton | 116/173 |
| 2,521,496 | 9/1950 | Worhun | 116/173 |
| 2,679,911 | 6/1964 | Bhend | 52/726 |
| 2,794,414 | 6/1957 | Reifschneider | 116/173 |
| 3,119,370 | 1/1964 | Keats | 116/173 |
| 3,377,765 | 4/1968 | Greeley | 52/726 |
| 3,587,520 | 6/1971 | Miller | 116/173 |
| 4,088,414 | 5/1978 | Fallein | 403/292 |
| 4,603,520 | 8/1986 | Deike | 52/98 |
| 4,700,655 | 10/1987 | Kirby | 116/173 |

*Primary Examiner*—James L. Ridgill, Jr.

*Attorney, Agent, or Firm*—Merchant, Gould, Smith, Edell, Welter & Schmidt

[57] ABSTRACT

An improved rotatable flagpole arrangement for supporting a flag or banner includes an elongate pole with structure thereon for mounting a flag or banner, a lower stop surface attached to the pole and a novel bearing arrangement between the stop surface and a support surface which utilizes a pair of embossed washers. The pole may be formed of a flexible material such as PVC so that it curves away from the wind as it rotates relative to the support socket, which creates a novel, dynamic visual effect.

12 Claims, 2 Drawing Sheets

ROTATABLE, FLEXIBLE FLAGPOLE ARRANGEMENT

BACKGROUND OF THE INVENTION

1. Field of the Invention

This invention relates generally to flagpoles, which are used to display flags or banners in an elevated, prominent position for visual observation. More specifically, this invention relates to an improved flagpole arrangement in which a flexible flagpole is rotatably mounted relative to a socket by an improved bearing arrangement so as to create a novel, dynamic visual effect.

2. Description of the Prior Art

Pole arrangements for supporting flags or like banners are widely known and are used in various environments for different purposes in the United States and throughout the world. The most common type of flagpole arrangement is one wherein a relatively rigid pole is fixedly secured within a ground mounted socket, usually for permanent use in one location.

One problem which plagues rigidly mounted flagstaffs is that the flag or banner may wrap itself around the staff or pole when the wind changes direction. In order to ameliorate this problem, flagpole arrangements have been developed which incorporate a bearing structure to permit rotation of the pole. For example, U.S. Pat. No. 3,587,520 to Miller utilizes a roller bearing arrangement for this purpose. U.S. Pat. No. 2,521,496 to Worhun relates to a self-righting roadway warning flag which incorporates a cotter pin which is slidingly supported on top of a washer in order to make the pole rotatable.

Flagpole arrangements are also used in recreational and marine environments for flying flags, windsocks, fish flags and the like. In such a recreational environment, it is important that the flagpole provide an aesthetically pleasing or dynamic visual effect as well as having the necessary functional attributes.

As designs for conventional and rotatable flagpole arrangements continue to evolve, it is recognized that improvements in economy of construction, functional efficiency and design, as well as improvements in appearance and visual effect are desirably singly and in varying degrees with each other. It is within this context that the detail hereinbelow.

SUMMARY OF THE INVENTION

It is an object of the invention to provide a rotatable flagpole arrangement which has an improved bearing structure which is economical to construct and which reduces friction between a flagpole and its support structure relative to those arrangements heretofore known.

It is further an object of the invention to provide a novel flagpole arrangement for use in marine and other recreational environments which is both flexible and rotatable relative to a mounting socket, so as to create a novel, dynamic visual effect which has not been previously realized.

In order to achieve these and other objects of the invention, a rotatable flagpole arrangement of the type which is adapted to be supported in a vertically extending pipe shaped socket which has an upper surface includes an elongate pole; structure on the pole which is adapted for retaining a flag or like banner; structure on the pole for defining a stop surface, the stop surface extending radially with respect to the pole and facing in a direction away from the retaining structure; a first bearing washer having a central opening for receiving the pole, a top surface which contacts the stop surface, and a bottom surface; and a second bearing washer having a central opening for receiving the pole, a top surface which contacts the bottom surface of the first bearing washer and a bottom surface which is adapted to be supported by the upper surface of the pipe shaped socket, whereby an inexpensive rotatable flagpole arrangement is provided which is responsive to the direction of a wind.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
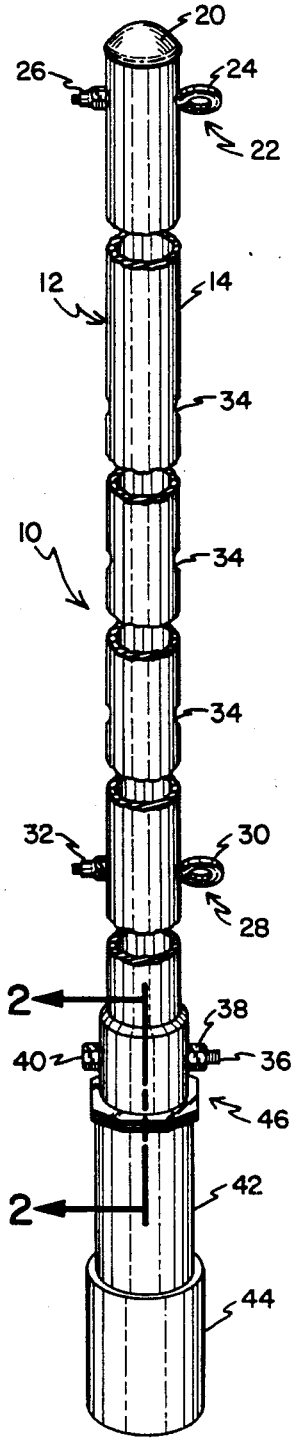
FIG. 1 is a perspective view of a flagpole arrangement constructed according to a first embodiment of the invention.

Referring now to the drawings, wherein like reference numerals designate corresponding structure throughout the views, and particularly to FIG. 1, a flagpole arrangement 10 constructed according to a first embodiment of the invention includes a vertically upstanding elongate pole 12 which has an upper flagpole section 14. Flagpole section 14 is provided with an outwardly flanged socket 16 on a lower end thereof. Pole 12 further includes a lower flagpole section 18 which is received within socket 16, as may be seen in FIG. 2. Pole 12 is preferably formed of a relatively flexible polymeric material such as polyvinylchloride (PVC), is preferably hollow and may be provided with a cap 20 at an upper end thereof to keep out water or detritus, as is illustrated in FIG. 1. As a result, pole 12 is sufficiently flexible to bend with the wind.

An upper flag retainer 22 is in the preferred embodiment constructed as an eyelet bolt 24 which may be inserted into any one of a number of radially extending retaining holes 34 which are defined in pole 12, as is shown in FIG. 1. A stop nut 26 fixes eyelet bolt 24 secure onto pole 12. In similar fashion, a lower flag retainer 28 is embodied as an eyelet bolt 30 which extends through a second one of the retaining holes 34 and is secured to pole 12 by a stop nut 32.

In order to secure upper flagpole section 14 to the lower flagpole section 18 and an internal support tube 56, which is discussed infra, a flagpole securing bolt 36 having a head 40 is radially positioned within a bore that is defined within the outwardly flanged socket 16 upper flagpole section 14, the lower flagpole section 18 and internal support tube 56 and is secured thereon by a friction nut 38. The term friction nut refers to a nut that is designed to resist manual unscrewing.

As shown in FIG. 1, flagpole arrangement 10 is insertable into a vertically extending pipe-shaped mounting socket 42, which in turn may be supported by a ground socket 44. The pipe-shaped socket 42 has a substantially horizontal upper surface, as may be seen in FIG. 2.

Figure 2:
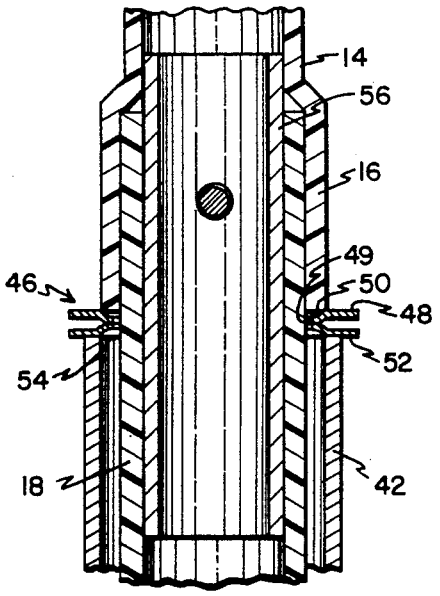
FIG. 2 is a cross-sectional view taken along lines 2—2 in FIG. 1.

Referring now to FIG. 2, a bearing arrangement 46 for rotatably supporting pole 12 with respect to mounting socket 42 will now be discussed. Bearing arrangement 46 consists of an upper, first bearing washer 48 and a lower, second bearing washer 52, each of which have a central opening for receiving the lower flagpole section 18 of pole 14, a top surface and a lower surface. Both washers 48, 52 are of conventional design, which means they have a radial dimension which is greater then their axial dimension. As may be seen in FIG. 2, the bottom surface of first bearing washer 48 is provided with an inner embossed portion 50 and the top surface of second bearing washer 52 is similarly provided with an inner embossed portion 54. Embossed portions 50, 54 reduce the friction between bearing washers 48, 52 thus permitting them to rotate about pole 12 with respect to each other with relatively little hindrance. Referring again to FIG. 2, the bottom surface of the second, lower washer bearing 52 rests top an upper surface of mounting socket 42, and the top surface of the first, upper washer bearing 48 supports a bottom radially extending stop 49 surface of flange socket 16. As may be seen in FIG. 1, stop surface 49 face is a direction away from flag retainer 22. In this way, the weight of flagpole arrangement 10 is axially and rotatably supported relative to mounting socket 42 by the bearing arrangement 46.

In order to protect bearing arrangement 46 and the connection between upper flagpole section 14 and lower flagpole section 18 from bending induced stresses which might otherwise result in breaking or binding, an internal metallic support tube 56 is tightly fitted within pole 12 in a position which is illustrated in FIG. 2. As has been previously discussed, flagpole securing bolt 36 extends through internal support tube 56 and secures it with respect to sections 14, 18 of pole 12.

Figure 3:
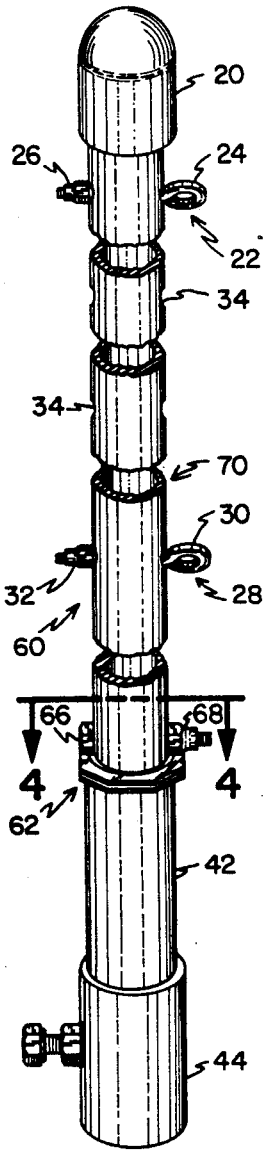
FIG. 3 is a perspective view of a flagpole arrangement constructed according to a second embodiment of the invention.
Figure 4:
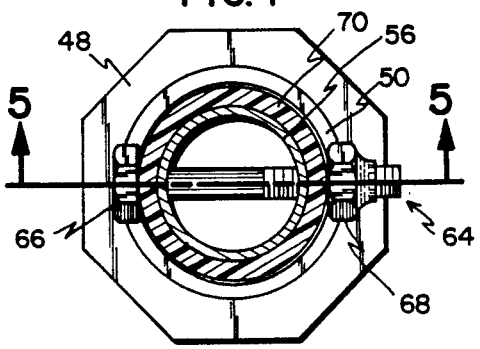
FIG. 4 is a cross-sectional view taken along lines 4—4 in FIG. 3.
Figure 5:
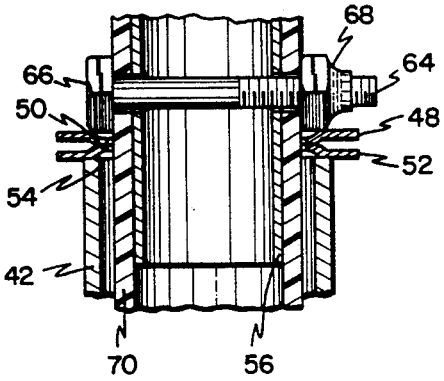
FIG. 5 is a partial cross-sectional view taken along lines 5—5 in FIG. 3.

Referring now to FIGS. 3–5, a flagpole 60 constructed according to a second embodiment of the invention will now be discussed. Flagpole arrangement 60 differs from the arrangement discussed previously with reference to FIGS. 1–3 in that it incorporates a second bearing arrangement 62 which includes a first, upper bearing washer 48 and a second, lower bearing washer 52 as discussed above with reference to FIG. 2, and a flagpole bearing support bolt 64 which extends through a radial hole in flagpole 70 and has a hexagonal head portion 66 and a hexagonal nut threaded thereon. One lower face of head portion 66 and a corresponding lower face of friction nut 68 serve as radially extending stop surfaces for resting upon an upper surface of upper washer bearing 48, as is shown in cross section in FIG. 5. In this way, the entire weight of flagpole 70 is rested upon bearing arrangement 62 by means of the flagpole bearing support bolt 64.

Figure 6:
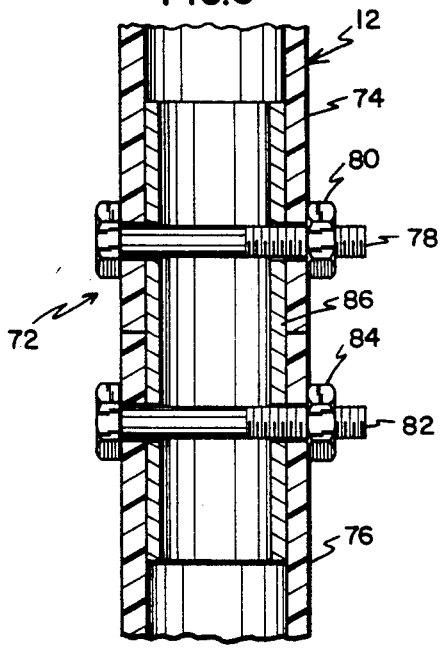
FIG. 6 is a cross-sectional view of a sectional splicing arrangement which may be used in conjunction with either of the previously illustrated embodiments.

In order to permit an efficient breakdown of a flagpole constructed according to either of the above described embodiments, a novel splicing arrangement 72 is depicted in FIG. 6. According to the preferred embodiment of splicing arrangement 72, a first length 74 of pole may be spliced to a second length 76 of pole by an internal splicing nipple 86 which is tightly inserted into each of the lengths 74, 76. Splicing nipple 86 is secured to first length 74 by a first splicing bolt 78 which extends through a radially extending hole formed in first length 74 and is secured thereon by a friction nut 80. Similarly, second length 76 is secured to internal splicing nipple 86 by a second splicing bolt 82 which extends through a radially extending hole defined in second length 76. Bolt 82 is secured to the pole by a friction nut 84.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A rotatable flagpole arrangement of the type which is adapted to be supported in a vertically extending pipe shaped socket which has an upper surface, comprising:

an elongate pole;

means on said pole which is adapted for retaining a flag or like banner;

means on said pole for defining a stop surface, said stop surface extending radially with respect to said pole and facing in a direction away from said retaining means;

a first bearing washer having a maximum radial dimension and a maximum axial dimension, said maximum radial dimension being greater than said maximum axial dimension, a central opening for receiving said pole, a top surface which contacts said stop surface, and a bottom surface; and a second bearing washer having a maximum radial dimension and a maximum axial dimension, said maximum radial dimension being greater than said maximum axial dimension, a central opening for receiving said pole, a top surface which contacts said bottom surface of said first bearing washer and a bottom surface which is adapted to be supported by the upper surface of the pipe shaped socket, whereby an inexpensive rotatable flagpole arrangement is provided which is responsive to the direction of a wind.

2. A flagpole arrangement according to claim 1, wherein said retaining means comprises a plurality of radially extending holes defined in said pole, a pair of eyelet bolts inserted into two of said holes, and means for securing each of said eyelet bolts into its respective hole.

3. A flagpole arrangement according to claim 1, wherein said stop surface defining means comprises a radially extending hole defined in said pole, a bolt extending through said hole and a nut for securing said bolt onto the pole, and said stop surface comprises one face on a head portion of said bolt, and one face on said nut.

4. A flagpole arrangement according to claim 1, further comprising cylindrical metallic means within a portion of said pole proximate said first and second bearing washers for reinforcing said pole against stress induced breaking and binding.

5. A flagpole arrangement according to claim 1, wherein said pole is formed of a material which is sufficiently flexible to bend with the wind.

6. A flagpole arrangement according to claim 5, wherein said material is PVC.

7. A flagpole arrangement according to claim 1, wherein said pole comprises an upper section and a lower section, said upper section having an outwardly flanged socket into which said lower section is received.

8. A flagpole arrangement according to claim 7, wherein said stop surface comprises a bottom surface of said outwardly flanged socket.

9. A flagpole arrangement according to claim 1, wherein at least one of said bottom surface of said first bearing washer and said top surface of said second bearing washer comprises embossed inner section means for reducing the amount of bearing surface which contacts the other of said sections, whereby bearing friction between said first bearing washer and said second bearing washer is reduced.

10. A flagpole arrangement according to claim 9, wherein both said bottom surface of said first bearing washer and said top surface of said second bearing washer comprise said embossed inner section means.

11. A flagpole arrangement according to claim 1, wherein said both comprises a first length; a second length and means for joining said first length to said second length.

12. A flagpole arrangement according to claim 11, wherein said joining means comprises a metallic splicing nippling which fits inside each of said first and second lengths; means for securing said first length to said nipple; and means for securing said second length to said nipple.

* * * * *

UNITED STATES PATENT AND TRADEMARK OFFICE

CERTIFICATE OF CORRECTION

PATENT NO. : 4,949,525

DATED : August 21, 1990

INVENTOR(S) : John H. Weaver

It is certified that error appears in the above-identified patent and that said Letters Patent is hereby corrected as shown below:

Column 1, line 47
INSERT --inventions assumes its significance, as is set forth in-- after the word "the"

Column 3, line 35
INSERT --upon-- in place of "top"

Column 3, line 37
INSERT --stop surface 49-- in place of "stop 49 surface"

Column 3, line 38
INSERT --faces in-- in place of "face is"

Column 6, line 17
INSERT --nipple-- in place of "nippling"

Signed and Sealed this

Sixteenth Day of June, 1992

*Attest:*

DOUGLAS B. COMER

*Attesting Officer*

*Acting Commissioner of Patents and Trademarks*